US010099828B1

(12) United States Patent
Defer

(10) Patent No.: US 10,099,828 B1
(45) Date of Patent: Oct. 16, 2018

(54) KOOLEE STEIN DRINK DEVICE

(71) Applicant: Kenneth J. Defer, Clinton Township, MI (US)

(72) Inventor: Kenneth J. Defer, Clinton Township, MI (US)

( * ) Notice: Subject to any disclaimer, the term of this patent is extended or adjusted under 35 U.S.C. 154(b) by 108 days.

(21) Appl. No.: 15/256,941

(22) Filed: Sep. 6, 2016

Related U.S. Application Data

(60) Provisional application No. 62/214,998, filed on Sep. 6, 2015.

(51) Int. Cl.
*B65D 51/04* (2006.01)
*B65D 51/00* (2006.01)
*B65D 43/06* (2006.01)

(52) U.S. Cl.
CPC ..... *B65D 51/04* (2013.01); *B65D 43/06* (2013.01); *B65D 51/007* (2013.01)

(58) Field of Classification Search
CPC .... B65D 51/007; B65D 51/04; B65D 51/242; B65D 51/243; B65D 51/24; B65D 43/06
USPC ..... 215/244
See application file for complete search history.

(56) References Cited

U.S. PATENT DOCUMENTS 924,922 A * 6/1909 Neely et al. ..... B65D 51/04 215/244
1,115,768 A * 11/1914 Baron ..... B65D 51/04 215/244
1,490,883 A * 4/1924 Baron ..... B65D 51/04 215/244

* cited by examiner

*Primary Examiner* — Stephen Castellano
(74) *Attorney, Agent, or Firm* — Ronald R. Kilponen

(57) ABSTRACT

A drink device 16 is shown and described. The drink device 16 can be located adjacent to a beverage can 17 such that a first position provides closure of the drinking hole 36 on the top of can 17. When the user applies a force to the drink device 16 the drinking hole 36 is exposed (second position) allowing the user to consume the beverage. When the force is removed from the drink device 16 another manual force is used to close the drinking device 16 adjacent to the drinking hole 36 or first or closed position. Alternatively, a spring 68 and spring force is used to bias the drinking device 16 against the drinking hole 36 and the top of the can 17 or back to the first or closed position. Decorative items such as stickers and sports paraphernalia can be affixed to the top of the pivot top.

4 Claims, 8 Drawing Sheets

Fig. 1
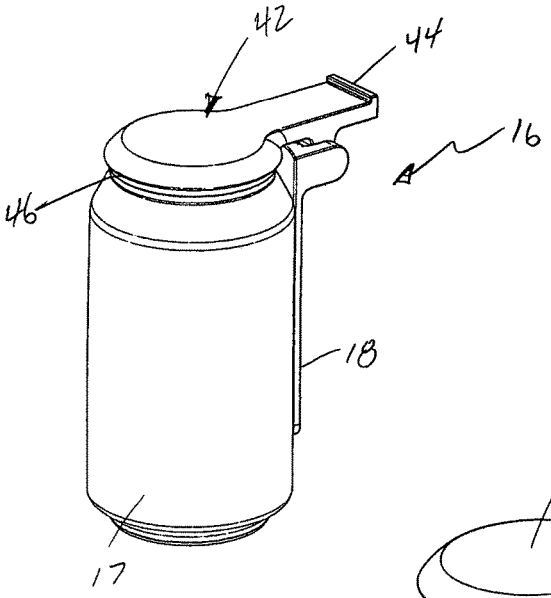
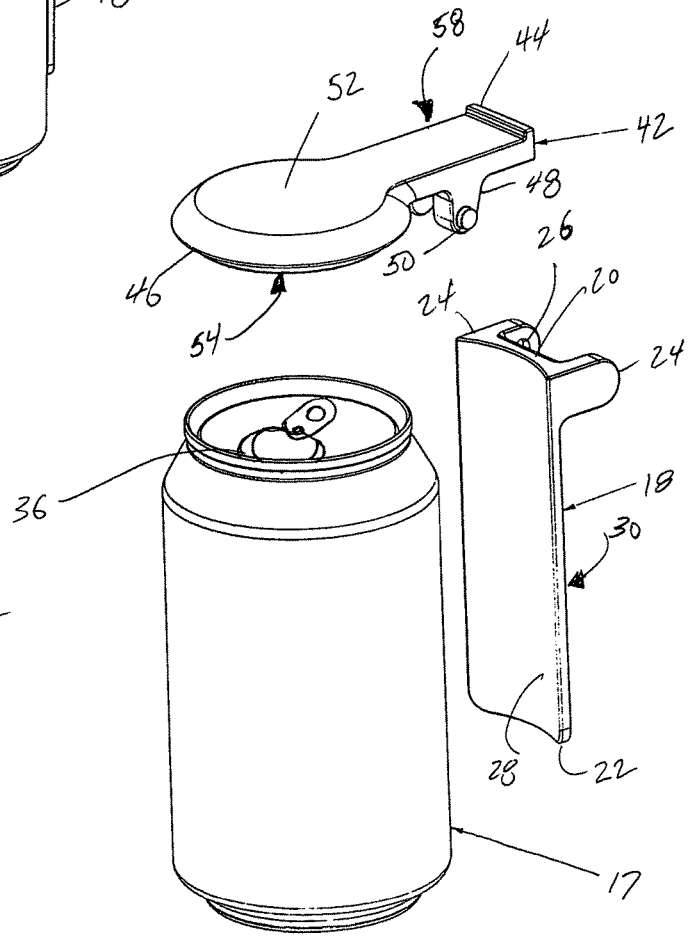
Fig. 2

KOOLEE STEIN DRINK DEVICE

CROSS REFERENCE TO RELATED APPLICATIONS

This application claims the benefit of U.S. Provisional Application No. 62/214,998 filed on Sep. 6, 2015, entitled "Koolee Stein Drink Device". The above identified Provisional Application for Patent is herein incorporated by reference in its entirety to provide continuity of disclosure.

FIELD

The present version of these embodiments relate generally to the field of devices that prevent insects, unwanted materials or debris from getting into a persons beverage can in a first position and in a second position, allows the user to consume the beverage from the can.

BACKGROUND

These embodiments relate to devices that prevent unwanted materials from getting into a users beverage can, and more particularly to a device that can be affixed to a beverage can and has a first position and second position. In the first position the device is closed against the top of the beverage can and in the second position allows the user to drink from the beverage can.

People enjoy drinking beverages and many types of beverages are canned. This includes water, soda, juices, alcoholic beverages and even milk have been known to come in readily available 12 or 11.5 ounce and many other sized cans. These cans are generally made from aluminum and one cannot view the amount of beverage in the can or the empty space, insects or debris in the can. These cans generally have a pop top where the user lifts a tab that forces a pre stamped indentation tab into the can opening the can, whereby the beverages can then be consumed.

While this is generally acceptable and well known, there can be issues with leaving the top of a beverage open and not closely monitoring the opening of the can. There have been many cases of insects especially bees and other stinging insects that are seeking sugary or other interesting smelling or aromatic liquids entering cans. There are well know cases of nefarious individuals dumping various drugs into another persons beverage can. If one is allergic to stinging insects the consequences of taking a drink from a can with a stinging insect inside can be very dangerous as they may then be stung in the mouth, throat, tongue or lips. This can cause a medical emergency. If illegal drugs are slipped into the beverage, other bad consequences can ensue as one can well imagine. When consuming beverages outdoors various other materials can fall into an open beverage can such as tree or bush debris or even bird feces.

There is a need for a device that has a first position that can seal off the opening of a beverage can when a user is not drinking; and have a second position that will allow the user to drink from the beverage can. It would be helpful if the device defaulted to the first position such that the user does not have to consciously engage the device to remember to position the device back to the first or sealed off position. This device should be relatively cheap, relatively fool proof and not be inconvenient to use such that persons drinking from beverage cans will utilize it.

For the foregoing reasons, there is a need for a Koolie Stein Drink Device.

SUMMARY

In view of the foregoing disadvantages inherent in the background art there is a need for a device that can seal off an open beverage container in a first position and allow consumption of the beverage in a second position.

A first objective of these embodiments is to provide a device that is relatively inexpensive to manufacture.

Another objective of these embodiments is to provide a device that will fit many different sized beverage cans.

It is yet another objective of these embodiments to provide a device that is attractive and novel in design and function.

Another objective of these embodiments is to provide a device that requires manual input to close the device.

It is a still further object of these embodiments to provide a device that automatically defaults to the closed position.

Another objective of these embodiments is to provide a device that requires a positive action by the user to provide access to the beverage in the can.

These together with other objectives of these embodiments, along with various features of novelty which characterize these embodiments, are pointed out with particularity in this application forming a part of this disclosure. For a better understanding of these embodiments, the operating advantages and the specific objectives attained by its uses, reference should be had to the accompanying drawings and descriptive matter in which there is illustrated a preferred embodiment.

BRIEF DESCRIPTION OF DRAWINGS

FIG. 1 shows a perspective view of one embodiment of the drink device in the first or closed position on a can.

FIG. 2 shows an exploded view of one embodiment of the drink device and can.

DETAILED DESCRIPTION

Figure 3:
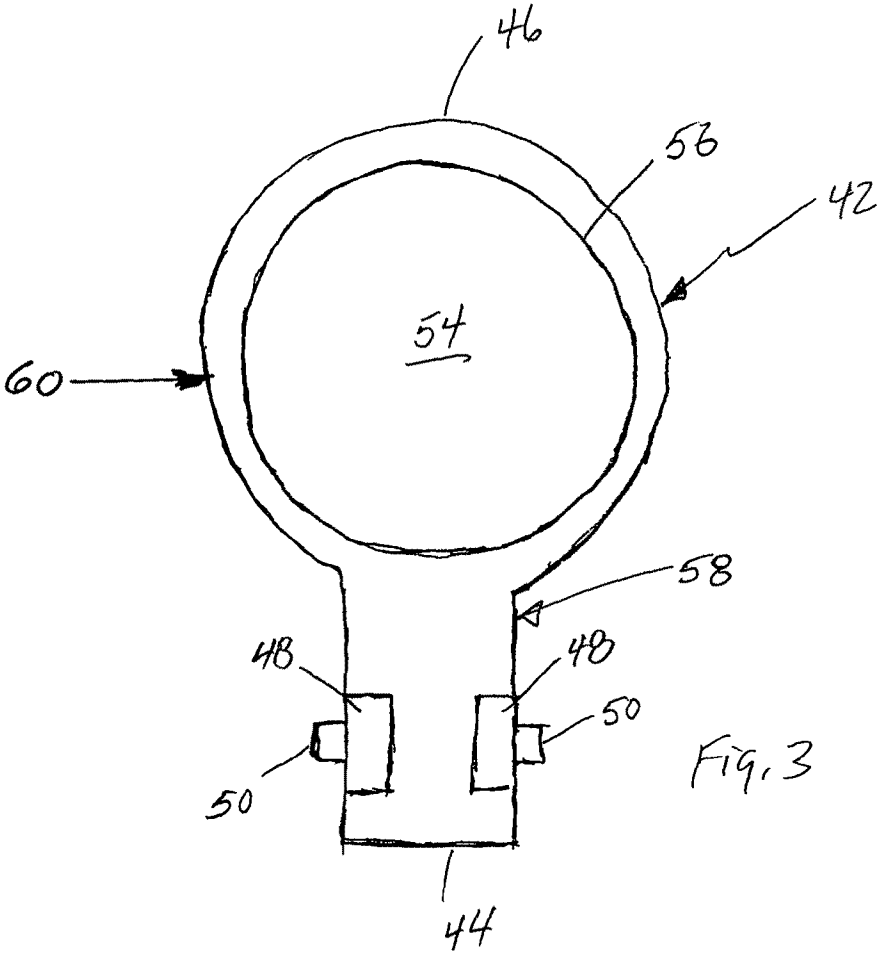
FIG. 3 shows a bottom view of one embodiment of the pivot top.

Referring to the drawings in detail wherein like elements are indicated by like numerals, there is shown in FIG. 1 a perspective view of one embodiment of the drink device 16 on affixed to a typical can 17. Many persons enjoy drinks from cans. One problem with having beverage cans in the out of doors and even in doors in some places, is that insects are many times attracted to the odor of the beverages. They tend to be drawn to the opening in the can by the smell. Many times they enter the can because of the aroma and can become trapped in the can. This can cause problems when a person drinks from the can. They can swallow the insect or be stung by the insect if it is a stinging insect. This drink device 16 can help alleviate that problem.

The drink device 16 has two major components, the arm 18 which has a top end 20 located near the top of the can 17 and a bottom end 22 which, when installed on the can 17 is near the bottom of the can, FIG. 2.

The pivot top 42 is connected to the arm 18. The pivot top 42 has a first end 44 and a second end 46. It also has a top 52 which is generally exposed when installed on the can 17 and a bottom 54 which is approximately the same size as the top of the can 17. Alternatively, the bottom 54 can be sized only larger than the drinking hole 36 in the can 17.

When in the first position, FIG. 1, the bottom 54 is approximately flush against the top of the can 17 sealing off the drinking hole 36 thereby preventing insects and other debris from easily entering the can 17. The pivot top 42 near the first end 44 has a pair of bosses 48 one on each side of the rectangular section 58, FIGS. 2, 3. Each of the bosses 48 has a post 50 which extends perpendicular from each of the bosses 48, best seen FIG. 3. The circular section 60 has a bottom 54 with a concentric ridge 56 extending from the bottom 54. The ridge 56 aids in sealing the bottom 54 of the pivot top 42 to the top of the can 17. It should be noted that the ridge 56 could be molded into the pivot top 42 or could consist of a rubber seal that can be affixed to the bottom 54 of the pivot top 42. Different thicknesses of rubber seal could be used and an alternative embodiment could show the seal made from a foam material that could have adhesive for affixing the foam to the bottom 54.

Figure 4:
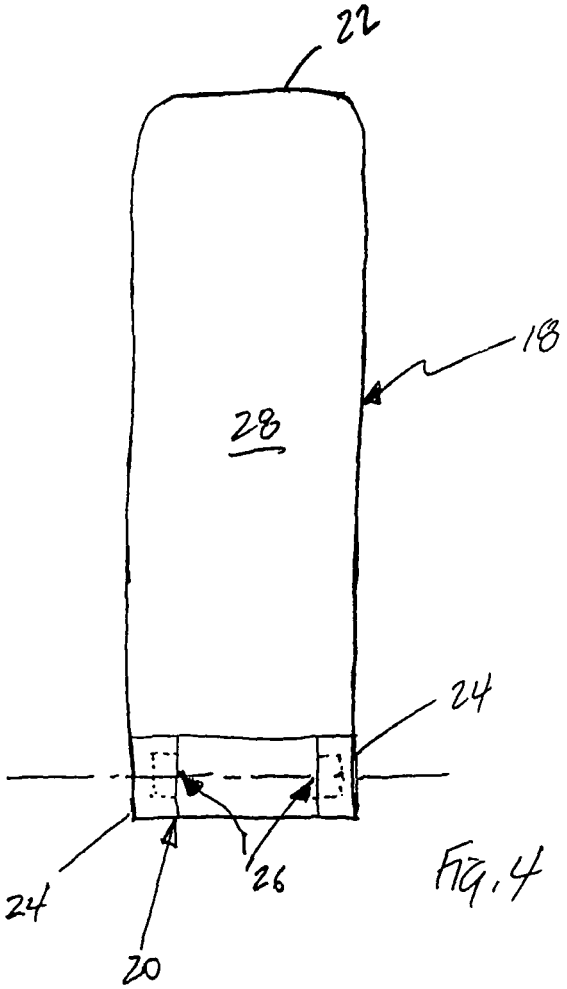
FIG. 4 shows the inner surface of one embodiment of the arm.

FIG. 4 shows the inner surface 28 of the arm 18. Near the top end 20 are located a pair of bosses 24. As can be seen, both bosses 24 each have a hole 26 that is for the insertion of one post 50 from the bosses 48 of the pivot top 42, also seen in FIGS. 2, 3. The holes 26 in the bosses 24 of arm 18 are for engaging the posts 50 on the bosses 48 of the pivot top 42. This allows the pivot top 42 to rotate relative to the arm 18.

Figure 6:
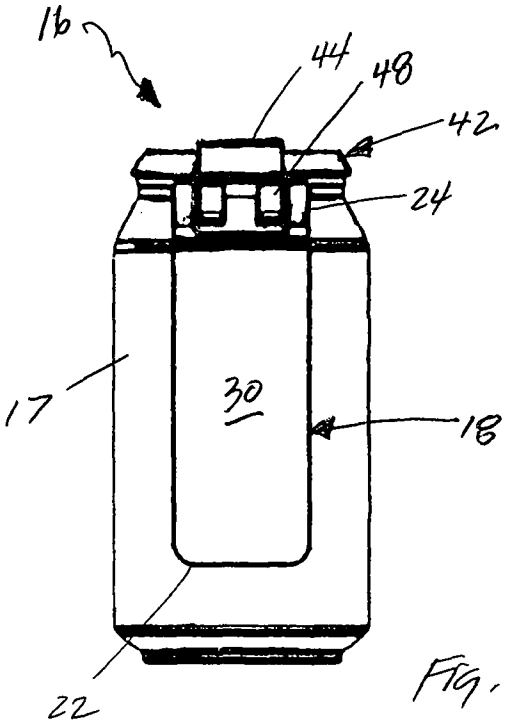
FIG. 6 shows another side view of one embodiment of the drink device located on a can in the closed or first position.
Figure 5:
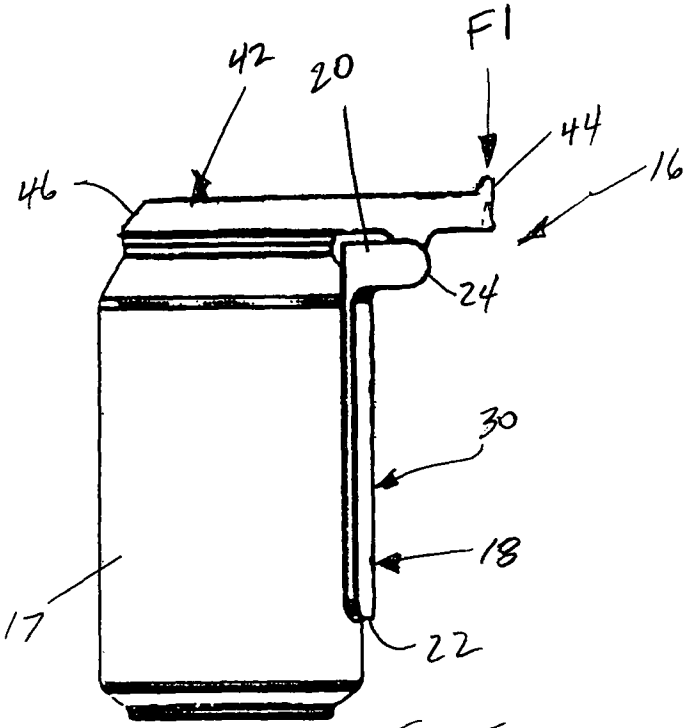
FIG. 5 shows a side view of one embodiment of the drink device in the closed or first position located on a can.

FIGS. 5 & 6 show alternative side views of the drink device 16 also located on a can 17 in the first position. The drink device 16 can be retained in the appropriate position on the can 17 via an elastic band or other elastic member (not shown). This elastic member could be a rubber band. An alternative method of affixing the drink device 16 to the can 17 could include double sided tape affixed to the inner surface 28 of the arm 18. While this method is operational, it may be difficult to affix the tape to a can that has condensation from humid weather. It may also be difficult to remove the adhesive and thereby the drink device 16 from the can when the can is empty. Various other methods of affixing the drink device 16 to can 17 are anticipated.

Another use for the drink device 16 is when a user has the can in an insulating device around the can (not shown), these insulating devices are well known in the market. The arm 18 inner surface 28 and outer surface 30 have a profile that nearly matches the outer surface of the can 17. This would allow the arm 18 to be inserted between the can and the insulating device and be retained in the appropriate position relative thereto, not shown.

Figure 7:
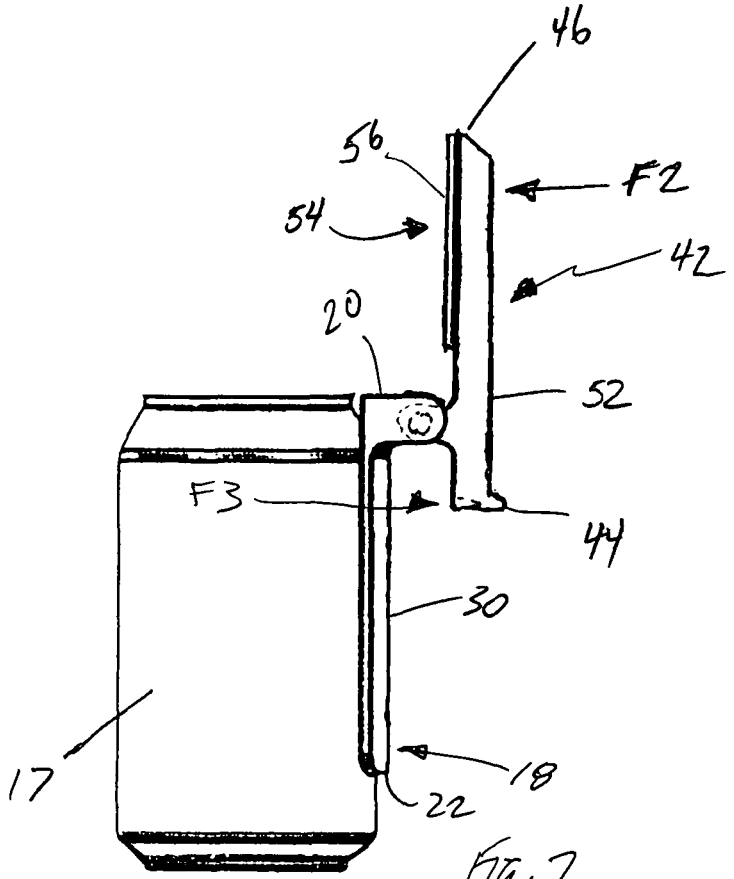
FIG. 7 shows a side view of one embodiment of the drink device on a can in the second or open position.

When the drink device 16 is affixed to the correct position relative to the can 17, the user can drink from the can 17 by placing, for example, the thumb of the hand onto the first end 44 of the pivot top 42 and applying a force F1 towards the bottom of the can 17, FIG. 5. This causes the posts 50 in the bosses 48 to rotate in the holes 26 in the bosses 24 near the top end 20 of the arm 18 causing the bottom 54 of the pivot top 42 to move from the first position FIG. 1 to the second position shown in FIG. 7 or any intermediate position there between. When the user has taken a drink from the drinking hole 36 in can 17, a force F2 or F3, FIG. 7, can be applied to the pivot top 42 and this thereby causes the pivot top 42 to rotate around the arm 18 back into the closed or first position shown in FIGS. 1, 5.

Figure 8:
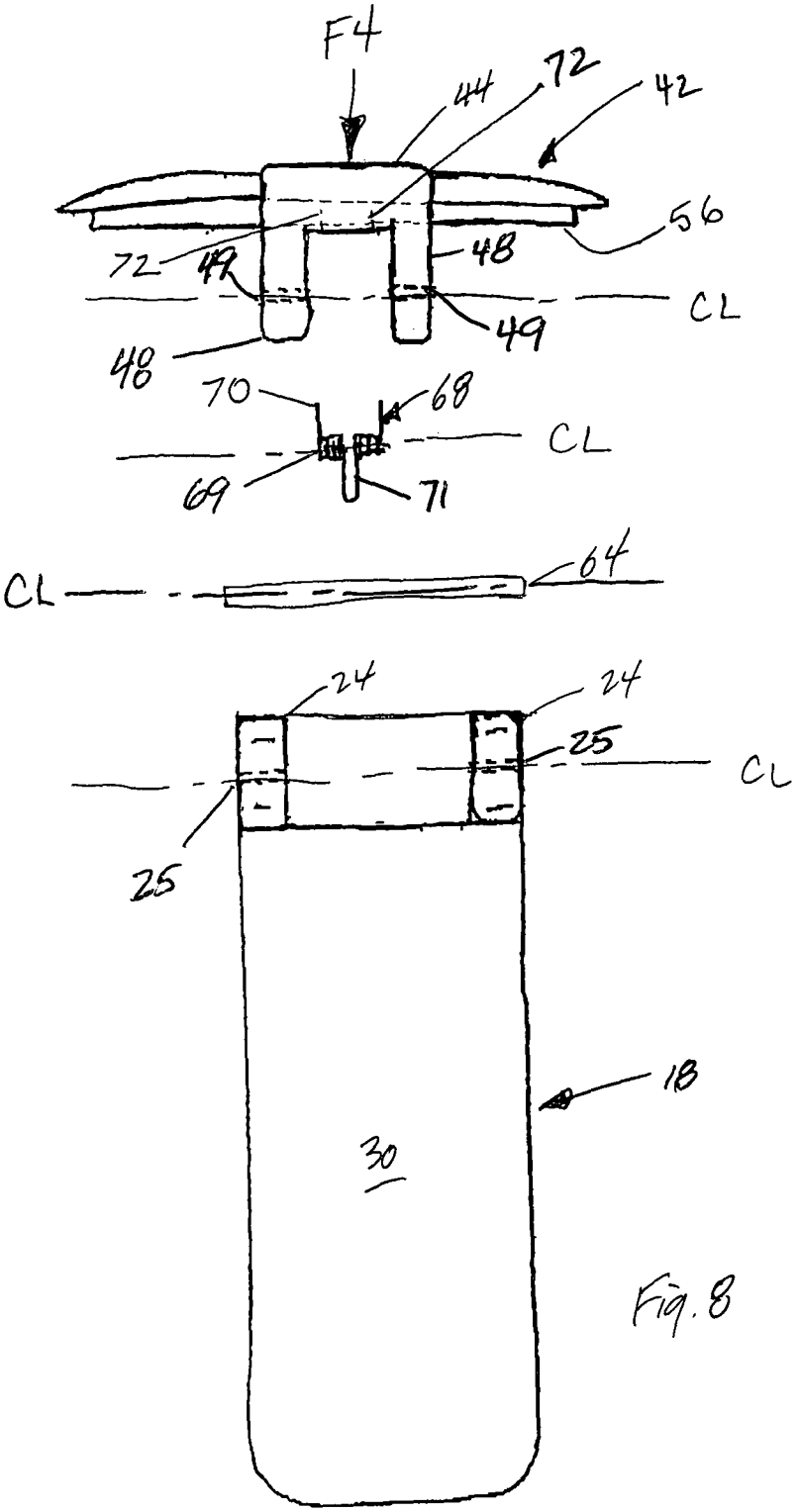
FIG. 8 shows an exploded view of another embodiment of the drink device.
Figure 9:
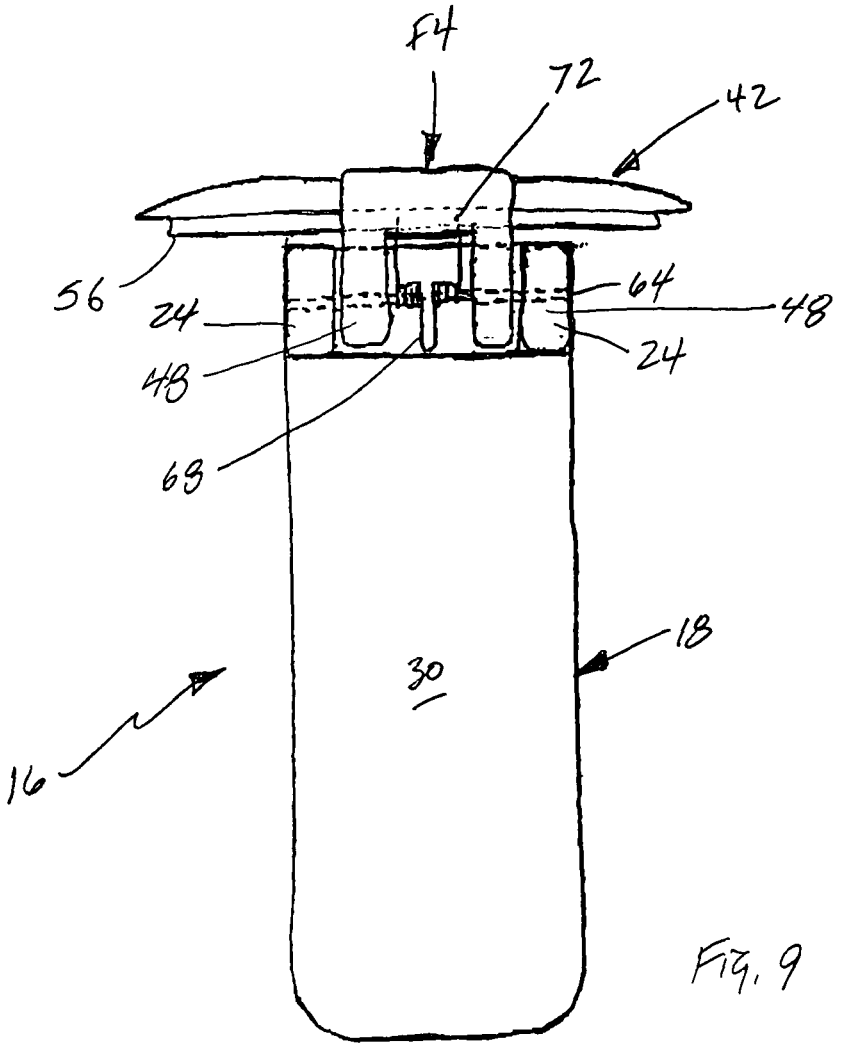
FIG. 9 shows a side view of the embodiment shown in FIG. 8 where the device is spring loaded and returns to the first or closed position when the opening force is removed from the device.

These embodiments show a human force to both open and close the drink device 16 against the top of the can 17. It should be understood that a spring could also be incorporated into the design to allow a spring force to retain the pivot top 42 against the top of the can 17, FIG. 8. The force F4, FIGS. 8,9, would move the bottom 54 from a position adjacent to the top of the can 17 and the spring would bias and return the bottom 54 to a position adjacent to the top of the can 17 when the force F4 was removed. One embodiment shown in FIGS. 8, 9 shows this spring return feature. In this embodiment, the pivot top 42 bosses 48 each have a boss hole 49 and do each of the arm 18 bosses 24 have arm holes 25. FIG. 8 shows an exploded view of the components of this embodiment.

The boss holes 49 in the bosses 48, 24 are co-linear and of approximately the same diameter for housing a pin 64. Pin 64 is inserted (FIG. 8) through the right most boss 24 of arm 18 arm hole 25 and then through the right most boss 48 boss hole 49 of pivot top 42. The pin 64 is then inserted through the spring 68 spring hole 69 and into the left boss 48 of pivot top 42 boss hole 49 and the left most boss 24 of arm 18 arm hole 25. The legs 70 of spring 68 are inserted into the bottom 54 surface of pivot top 42 in holes 72. This thereby provides a rotational force to the pivot top 42 biasing the pivot top 42 back against the top of can 17 following application of force F4, FIGS. 8,9. FIG. 9 shows an assembled side view of one embodiment the drink device 16 with the spring 68 feature.

Figure 10:
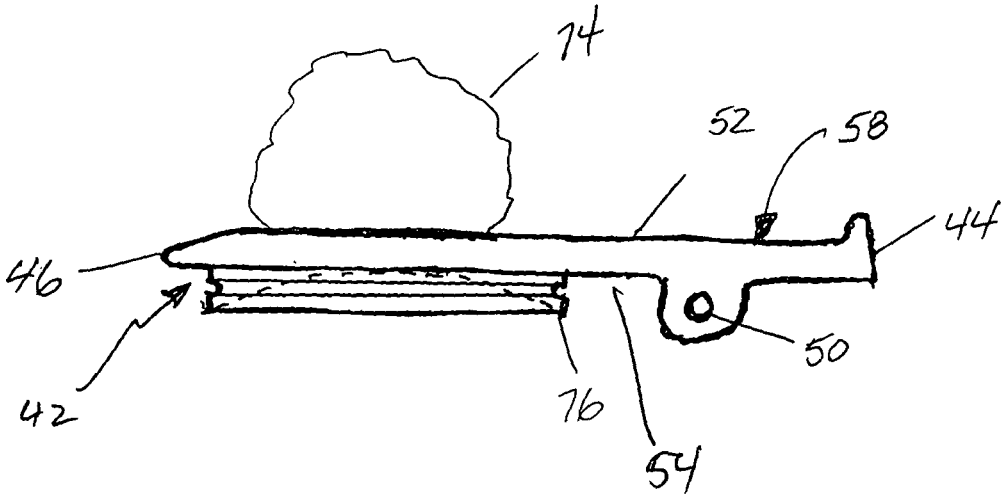
FIG. 10 shows a side view of another embodiment of the pivot top.

FIG. 10 shows an alternative embodiment of the pivot top 42 including a decorative item 74 which can be affixed to the top 52 of the pivot top 42. Also shown in FIG. 10 is an alternative embodiment of the bottom 54 having a seal 76 which can be compressible against the top of the can 17. The decorative item 74 and seal 76 are not restricted to use in these embodiments with each other.

It will now be apparent to those skilled in the art that other embodiments, improvements, details and uses can be made consistent with the letter and spirit of the foregoing disclosure and within the scope of this application.

The invention claimed is:

1. A device removably attached to and for selectively covering and uncovering the drinking hole in a beverage can, the device comprising:

a pivot top having a top and a bottom, the pivot top having a second end and a first end, the first end having a rectangular section with a pair of bosses located near the bottom, one co-linear boss hole located in each boss, a pair of holes located between the bosses in the bottom;

an arm, the arm having an inner surface and an outer surface, a top end and a bottom end, the top end having a pair of bosses extending away from the outer surface, each boss having a co-linear arm hole; and a pin, the pin inserted into one arm hole in the arm and through a corresponding adjacent boss hole in the boss of the pivot top, the pin inserted through a longitudinal center axis of a coiled spring such that the spring is located on the pin, the spring having a pair of legs, said legs inserted into holes in the bottom of the pivot top between the bosses, the pin inserted through the opposite boss hole of the pivot top and into the arm hole in the arm whereby the pivot top rotates on the pin relative to the arm and the spring biases the bottom of the pivot top against the top of the can.

2. The device of claim 1, further comprising:

a ridge located on the bottom for sealing the drinking hole.

3. The device of claim 1, further comprising:

a seal located on the bottom for sealing the drinking hole.

4. The device of claim 1, further comprising:

a decorative element located on the top.

* * * * *